US008075325B1

(12) United States Patent
Kao et al.

(10) Patent No.: US 8,075,325 B1
(45) Date of Patent: Dec. 13, 2011

(54) SELF-CLEANING ELECTRICAL CONNECTION ASSEMBLY

(75) Inventors: Selvin Kao, Ladera Ranch, CA (US); Philip Carlo J. DeGuzman, Fontana, CA (US)

(73) Assignee: Standard Cable USA, Inc., Rancho Santa Margarita, CA (US)

( * ) Notice: Subject to any disclaimer, the term of this patent is extended or adjusted under 35 U.S.C. 154(b) by 0 days.

(21) Appl. No.: 12/938,320

(22) Filed: Nov. 2, 2010

(51) Int. Cl.
*H01R 4/60* (2006.01)

(52) U.S. Cl. ..... 439/205; 438/141

(58) Field of Classification Search ..... 439/205, 439/206, 186, 187, 135, 136, 137, 141, 271–283
See application file for complete search history.

(56) References Cited

U.S. PATENT DOCUMENTS 4,445,739 A * 5/1984 Wooten ..... 439/140
4,708,662 A * 11/1987 Klein ..... 439/353

* cited by examiner

*Primary Examiner* — Ross Gushi
(74) *Attorney, Agent, or Firm* — Vic Lin; Innovation Capital Law Group, LLP

(57) ABSTRACT

An electrical connector assembly that detaches and mates in wet or contaminated environments is disclosed. The electrical connector assembly is configured for displacing and draining water and other contaminants from contact pins and surrounding surfaces during the connection process. As the electrical connector assembly is mated, water and other containments are removed from the contact pins and the surfaces surrounding the contact pins. This prevents contact pins from electrically shorting with other contact pins as a result of undesired current flow through the water collected on the surface.

18 Claims, 12 Drawing Sheets

SELF-CLEANING ELECTRICAL CONNECTION ASSEMBLY

BACKGROUND OF THE INVENTION

1. Field of the Invention

The present invention relates in general to electrical connections. More particularly, the invention is directed to detachable, self-cleaning electrical connections.

2. Description of the Related Art

Electrical connectors are employed in numerous applications and environments. Many applications require detachable electrical connectors that detach and mate in wet or dirty environments. When the electrical connectors are decoupled, water may collect on exposed electrical pins which may create electrical shorts among nearby pins. Moreover, dirt and other contaminants may accumulate on the exposed pins to form a layer of insulation that impedes current flow across a set of mating connectors.

Accordingly, a need exists to improve detachable electrical connections that detach and mate in wet environments.

SUMMARY OF THE INVENTION

In the first aspect, an electrical connector assembly is provided. The assembly comprises a first housing having at least one male elongated pin member and a second housing configured to mate with the first housing, the second housing having at least one opening for receiving a corresponding male elongated pin member of the at least one male elongated pin member, where the second housing is configured for displacing contaminants to a drainage pathway during a process of connecting the second housing and the first housing.

In a first preferred embodiment of the electrical connector assembly, the second housing further comprises a top surface and at least one locking tab, where at least one male elongated pin member extends beyond the top surface of the second housing when the second housing is coupled to the first housing. At least one opening preferably forms at least one fluid-tight annular space surrounding the corresponding male elongated pin member during the process of connecting the second housing and the first housing. The process of connecting the second housing and the first housing further comprises wiping contaminants from the corresponding male elongated pin member and displacing contaminants between the first housing and the second housing, where the contaminants from the corresponding male elongated pin member and the contaminants between the first housing and second housing are discharged through the drainage pathway. The electrical connector assembly preferably has a third housing having at least one female connector adopted for receiving the corresponding male elongated pin member.

The electrical connector assembly has a connector body casing having drain ports and at least one notch, where the first housing is affixed to the connector body casing, where the second housing is adopted for locking in place on the first housing by the at least one locking tab on the second housing engaging with the at least one notch on the connector body casing.

In a second preferred embodiment, the first housing has at least one cylindrical cavity that extends away from the top surface of the first housing, where at least one male elongated pin member is aligned with the axis of the cylindrical cavity and extends from the bottom of the cylindrical cavity. The drainage pathway has at least one drainage slot that fluidly couples at least one cylindrical cavity with an outer surface of the first housing, where at least one drainage slot extends from the top surface of the first housing, along the length of the at least one cylindrical cavity, and extends below the bottom of the at least one cylindrical cavity. The second housing preferably has at least one cylinder configured to mate with a corresponding cylindrical cavity of the at least one cylindrical cavity, where at least one cylinder extends from an inner surface of the second housing, where the at least one cylinder has one opening of the at least one opening, where the opening further comprises a female electrical connector adopted for receiving the corresponding male elongated pin member. At least one cylinder cavity preferably has four ridges protruding from the inner surface of the at least one cylinder cavity and extending along the length of the at least one cylinder cavity. At least one cylinder preferably has four indentations extending along the length of the at least one cylindrical cavity.

At least one cylinder and the corresponding cylinder cavity forms a fluid-tight annular space surrounding the at least one cylinder during the process of connecting the second housing and the first housing, where the opening and the corresponding male elongated pin member forms another fluid-tight annular space surrounding the corresponding male elongated pin member during the process of connecting the second housing and the first housing. The process of connecting the second housing and the first housing further comprises wiping contaminants from the at least one male elongated pin member, and displacing contaminants between the at least one cylinder and the corresponding cylindrical cavity, where the contaminants from the at least one male elongated pin and the contaminants between the at least one cylinder and the corresponding cylindrical cavity are discharged through the at least one drainage slot. The second housing preferably has a shroud that surrounds at least one cylinder, where the shroud has an inner tapered surface that is adopted for aligning and mating with the first housing. At least one cylinder cavity further comprises four cylinder cavities, and at least one cylinder further comprises four cylinders.

In another aspect, the electrical connector assembly comprises a male connector assembly and a female connector assembly. The male connector assembly further comprises a male terminal positioner having four male elongated pin members, and a male connector housing having four cylindrical cavities, where each cylindrical cavity has an opening configured for accepting a corresponding male elongated pin member of the four elongated pin members. The male terminal positioner is configured for coupling with the male connector housing to form the male connector assembly. The female connector assembly further comprises a female terminal positioner having four female connectors having open end portions configured for receiving a corresponding male elongated pin member of the four male elongated pin members and a female connector housing having four cylinders having axial openings configured for accepting a corresponding female connector of the four female connectors, where the four cylinders are configured to mate with corresponding cylindrical cavities. The female terminal positioner is configured for coupling with the female connector housing to form the female connector housing. The male connector assembly is configured for coupling with the female connector assembly.

In a third preferred embodiment, the male connector housing further comprises four drainage slots that fluidly couples each cylindrical cavity with an outer surface of the male connector housing, where each drainage slot of the four drainage slots extends from the uppermost surface of the male connector housing, along the length of the each cylindrical cavity, and extends below the bottom of the each cylindrical cavity. Each cylinder cavity preferably further comprises four ridges protruding from the inner surface of the each cylinder cavity and extending along the length of each cylinder cavity, where each cylinder preferably further comprises four indentations running along the length of the each cavity.

Each cylinder and the corresponding cylinder cavity forms a fluid-tight annular space surrounding the each cylinder during the process of connecting the male connector assembly and the female connector assembly, where the each opening and the corresponding male elongated pin member forms another fluid-tight annular space surrounding the corresponding male elongated pin member during the process of connecting the male connector assembly and the female connector assembly. The process of connecting the male connector assembly and the female connector assembly preferably further comprises wiping contaminants from the four male elongated pin members, and displacing contaminants between the four cylinders and the corresponding cylindrical cavities, where the contaminants from the four male elongated pin members and the contaminants between the four cylinders and the corresponding cylindrical cavities are discharged through one or more drainage slots of the four drainage slots. The female connector housing further comprises a shroud surrounding the four cylinders, where the shroud has an inner tapered surface that is adopted for aligning female connector housing and the male connector housing.

In a third aspect, the electrical connector assembly comprises a male connector housing and a female connector housing assembly The male connector housing has four cylindrical cavities that extend away from the top surface of the male connector housing. Each cylindrical cavity of the four cylindrical cavities has a male elongated pin member that is aligned with the axis of each cylindrical cavity and extends from the bottom of each cylindrical cavity. Each cylindrical cavity has one drainage slot that extends from the top surface of the male connector housing, along the length of each cylindrical cavity, and below the bottom of each cylindrical cavity. Each cylinder cavity has four ridges protruding from the inner surface of each cylinder cavity and extending along the length of each cylinder cavity.

The female connector housing has four cylinders that extend from an inner surface of the female connector housing. Each cylinder is configured to mate with a corresponding cylindrical cavity of the four cylindrical cavities. Each cylinder has one opening located at the axis of each cylinder. The opening has a female electrical connector adopted for receiving the corresponding male elongated pin member. Each cylinder has four indentations extending along the length of each cylindrical cavity. The female connector housing has a shroud that surrounds the four cylinders. The shroud has an inner tapered surface that is adopted for aligning and mating with the male connector housing.

Each cylinder and the corresponding cylinder cavity forms a fluid-tight annular space surrounding each cylinder during a process of connecting the female connector housing and the male connector housing. The opening and the corresponding male elongated pin member forms another fluid-tight annular space surrounding the corresponding male elongated pin member during the process of connecting the female connector housing and the male connector housing. The contaminants from the corresponding male elongated pin and the contaminants between each cylinder and the corresponding cylindrical cavity are discharged through the drainage slot of each cylindrical cavity.

These and other features and advantages of the invention will become more apparent with a description of preferred embodiments in reference to the associated drawings.

DETAILED DESCRIPTION OF THE PREFERRED EMBODIMENTS

The following preferred embodiments are directed to electrical connector assemblies that detach and mate in wet or contaminated environments. Such electrical connector assemblies may be useful for household and industrial appliances, such as in vacuum cleaners, floor cleaners, rug cleaners, and other devices requiring an electrical connection which may be exposed to contaminants. The electrical connector assemblies are configured for displacing and draining contaminants from contact pins and surrounding surfaces during the mating process in a preferred embodiment. Contaminants may include water, dust, mud, and other materials that may rest on exposed surfaces and interfere with the operation of the electrical connector assembly. For example, as the electrical connector assembly is mated, water from a wet environment is removed from the contact pins and the surfaces surrounding the contact pins. This prevents contact pins from electrically shorting with other contact pins as a result of undesired current flow through the water collected on the surface.

Figure 1A:
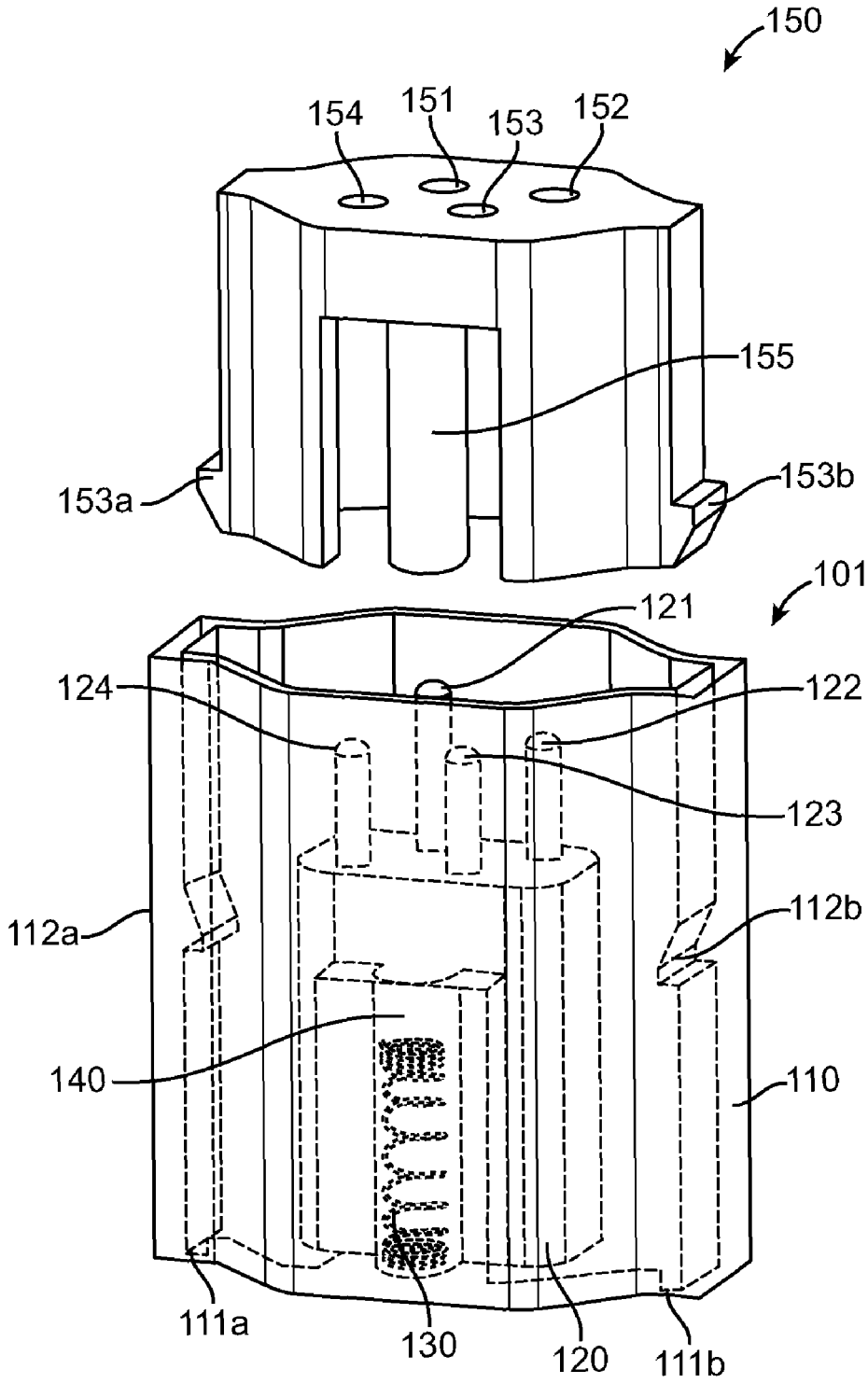
FIG. 1A is an exploded, perspective view of a first preferred embodiment of an electrical connector assembly that may detach and mate in wet or contaminated environments.

FIG. 1 is an exploded, perspective view of a first preferred embodiment of an electrical connector assembly that may detach and mate in wet or contaminated environments. main connector 101 has connector body 120 that holds four male pins 121, 122, 123, and 124. Male pins 121-124 are male elongated pin members and may be nickel-plated solid-machined-contacts in a preferred embodiment. Protective case cap 150 is configured to mate with connector body 120. Connector body 120 has four male pin ports 151-154 which correspond with male pins 121-124. Male pin ports 151-154 are through-hole openings which have a diameter slightly larger than the outer diameter of male pins 121-124 such that male pins 121-124 are wiped and cleaned as protective case cap 150 is pressed onto connector body 120.

Figure 1B:
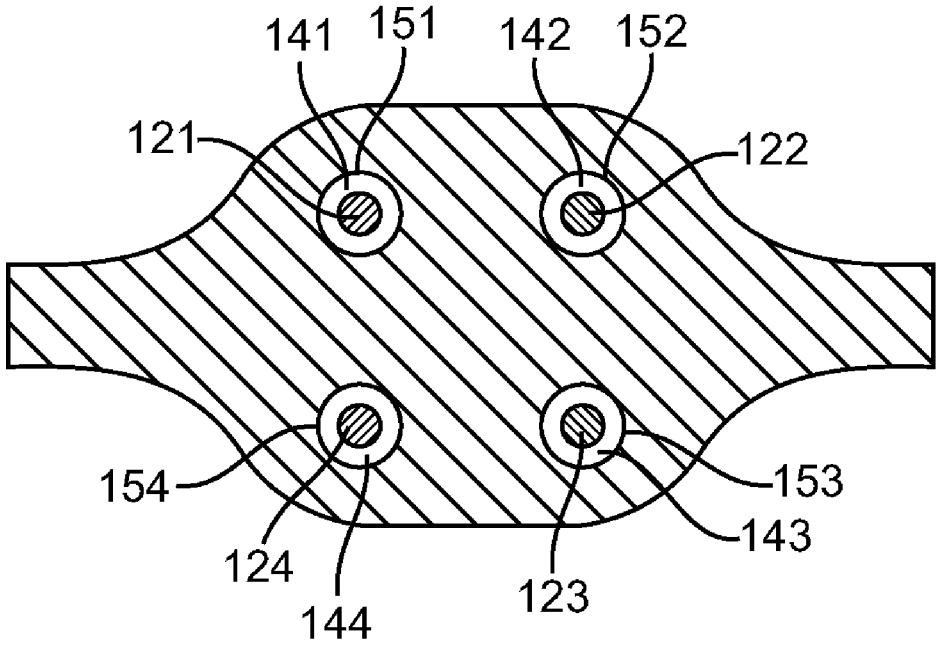
FIG. 1B is a cross-sectional, top view of protective case cap mating with the connector body.

FIG. 1B is a cross-sectional, top view of protective case cap 150 mating with connector body 120. In the preferred embodiment, fluid-tight annular spaces 141-144 surrounding male pins 121-124 are formed when protective case cap 150 is pressed onto connector body 120. Male pin ports 151-154 preferably employ a silicon pin wipe. The connection process also displaces contaminants between the mating surface of protective case cap 150 and the top mating surface of connector body 120. As a result, any water or other contaminants that may have been present on male pins 121-124 and the top surface of connector body 120 will be displaced and drained off the top of connector body 120. Water and other contaminants may then drain from main connector 101 via drain ports 111*a* and 111*b*. Male pins 121-124 preferably extend beyond the top of protective case cap 150 when protective case cap 150 is coupled to connector body 120.

Protective case cap 150 preferably engages with and is coupled to connector body 120 as a result of locking tabs 153*a* and 153*b* engaging with notches 112*a* and 112*b* of the connector body housing 110. Other forms of coupling, such as fasteners, screws, and adhesives, etc., may also be employed. Male pin 121 may be connected to electrical ground and may preferably be longer than the other male pins 122-124 such that the ground connection is the first to mate and the last to beak during detachment. While connector body 120 is depicted as having four male pins 121-124, connector body 120 may hold one or more male pins. A water-tight seal is preferably placed between protective case cap 150 and connector body 120.

Protective case cap 150 preferably includes spring plunger 155 which is configured to engage with plunger guide 140 and engage spring 130 affixed to the bottom inner surface of connector body housing 120. Spring plunger 155 may be employed to prevent a user from accidentally touching live pins during assembly for example. Plunger guide 140 is employed to prevent spring plunger 155 from deforming.

Figure 2:
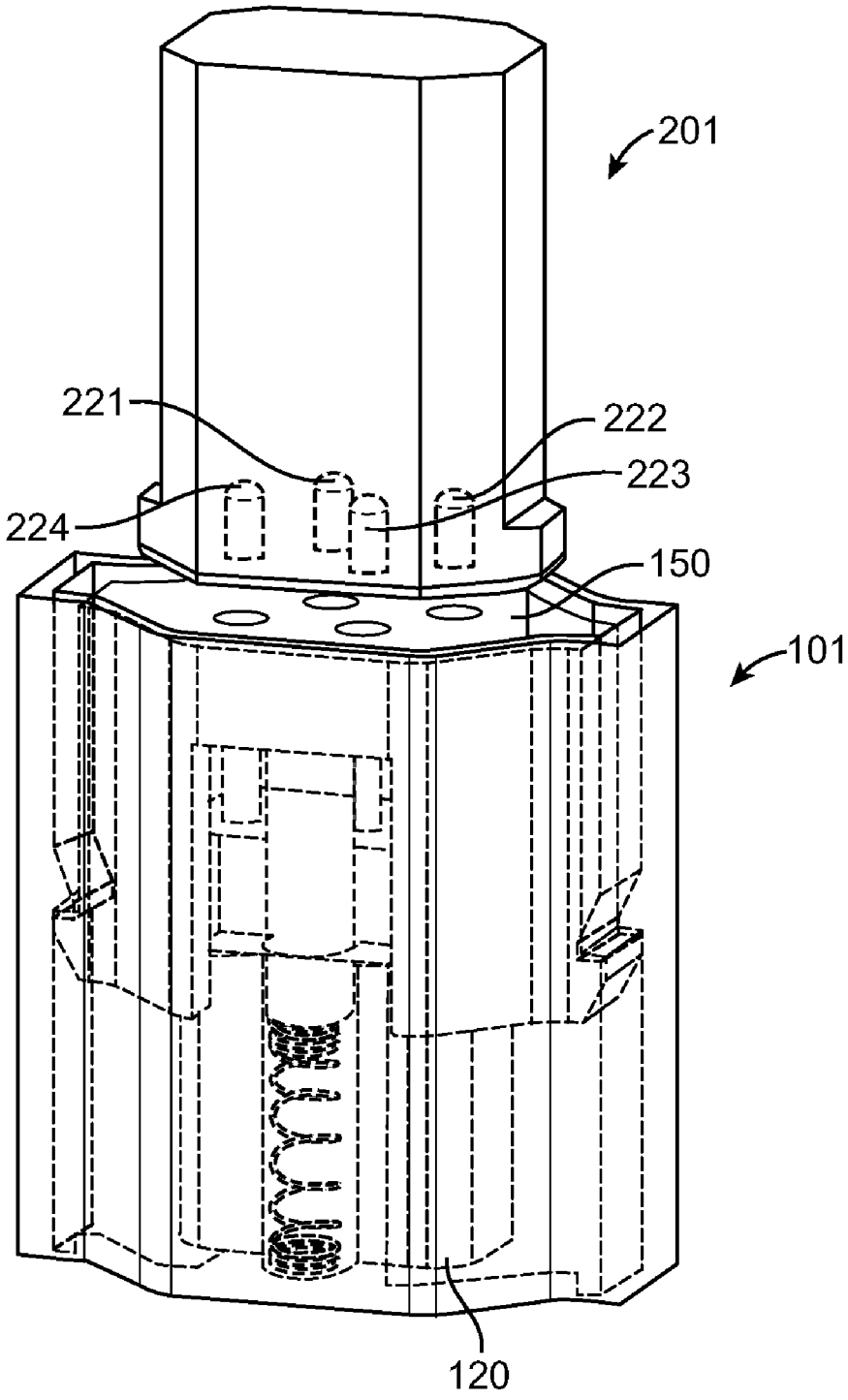
FIG. 2 is an exploded, perspective view of the first preferred embodiment of the electrical connector assembly comprising a pod having female connectors, a protective case cap, and a main connector.

FIG. 2 is an exploded, perspective view of the first preferred embodiment of the electrical connector assembly comprising pod 201 having female connectors 221-224, protective case cap 150, and main connector housing 110. Female connectors 221-224 receive male pins 121-124 to form electrical connections between the female connectors 221-224 and male pins 121-124.

Figure 3:
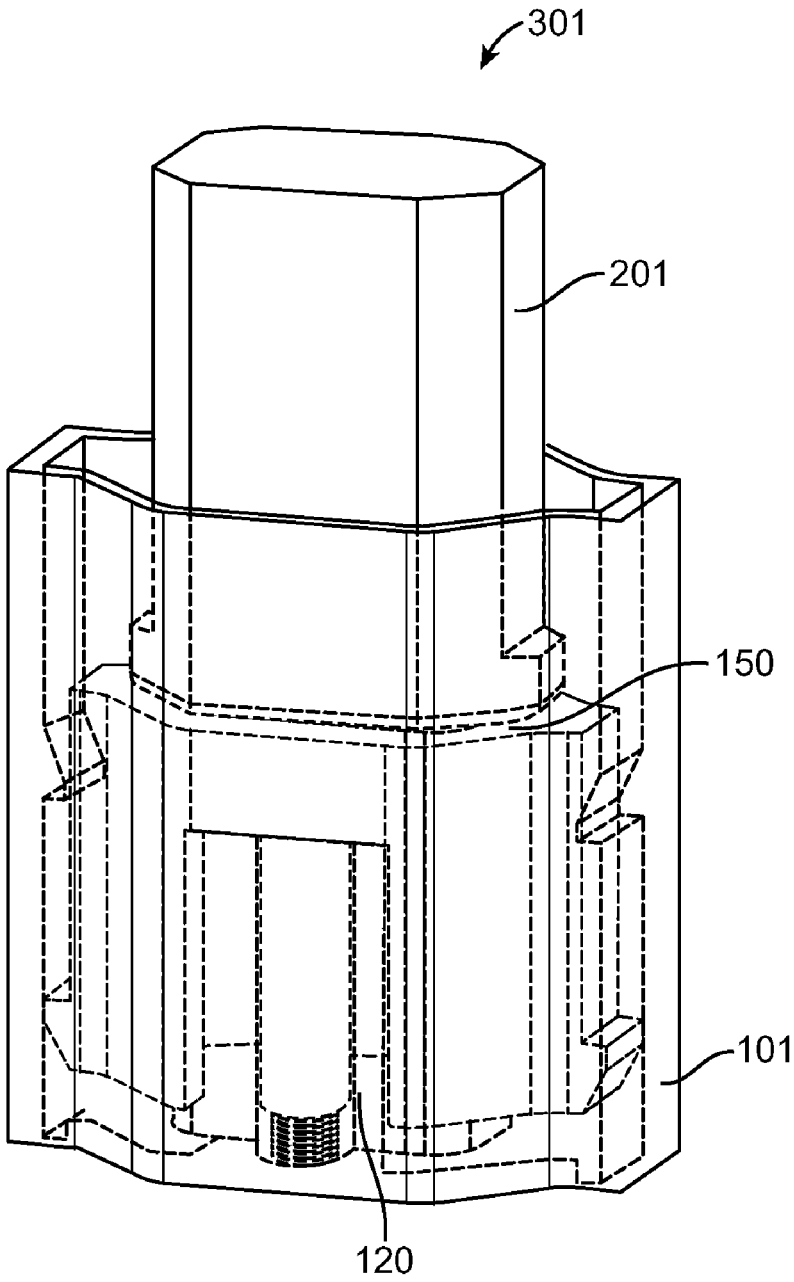
FIG. 3 is an assembled, perspective view of an assembled electrical connection of the pod, the protective case cap, and the main connector.

FIG. 3 is an assembled, perspective view of coupled assembly 301 of pod 201, protective case cap 150, and main connector 101. Coupled assembly 301 is assembled by pressing downward and "snapping in" the components together. Coupled assembly 301 may be a permanent assembly or may be subsequently detached. A silicone seal preferably may be placed between pod 201 and protective case cap 150. Coupled assembly 301 provides a reliable "touch protection" feature such that the physical shape of the components prevent users from accidently touching live pins during the detachment and mating processes. Connector body 120 may act as a female connection guide and may provide an indexed connector system. Protection case cap 150 may be keyed with a female connector insertion.

Figure 4A:
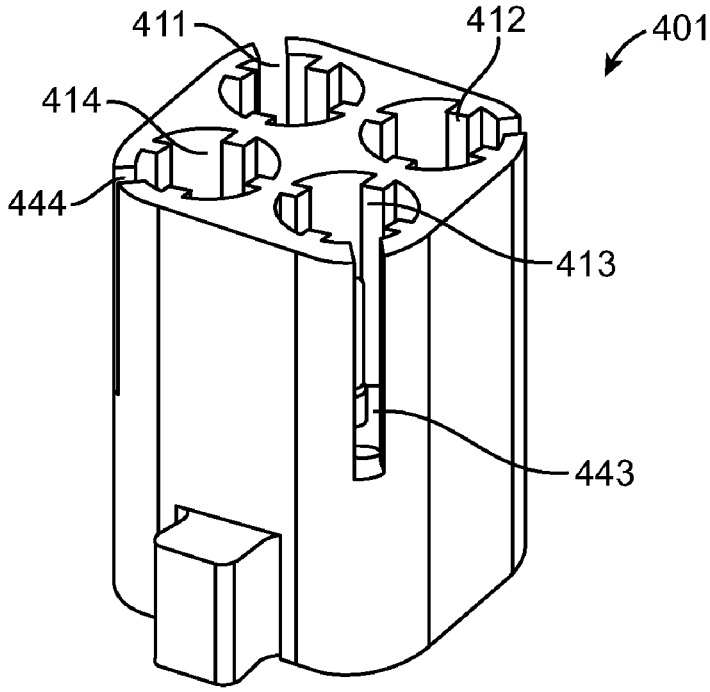
FIG. 4A is a side, perspective view of a second preferred main connector body of an electrical connector assembly that may detach and mate in wet or contaminated environments.
Figure 4B:
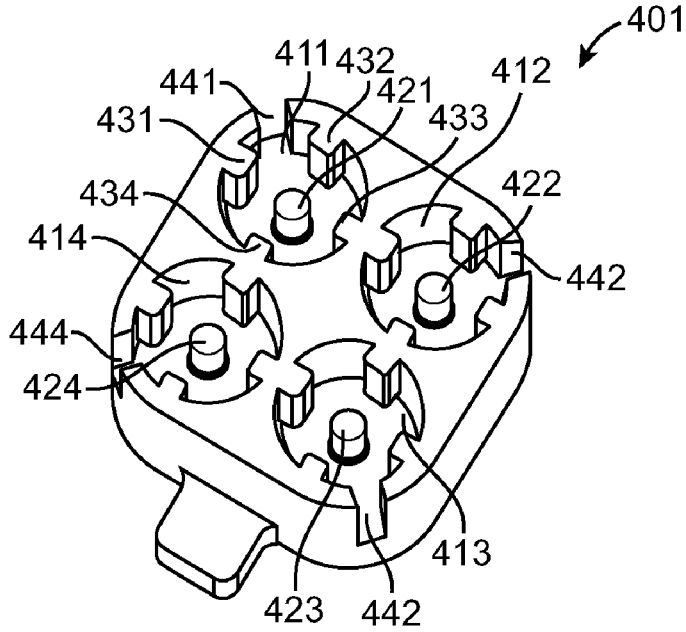
FIG. 4B is a top, perspective view of a second preferred main connector body of an electrical connector assembly that may detach and mate in wet or contaminated environments.

FIG. 4A is a side, perspective view and FIG. 4B is a top, perspective view of a second preferred main connector body 401 of an electrical connector assembly that may detach and mate in wet or contaminated environments. Main connector body 401 has four cylindrical cavities 411, 412, 413, and 414 that extend away from the top surface of main connector body 401. Male pins 421-424 are aligned with the axes of cylindrical cavities 411-414 and extend from the bottom of cylindrical cavities 411-414. Each of the cylindrical cavities 411-414 are physically separated from adjacent cylindrical cavities such that the male pins 421-424 are electrically isolated even in the presence of water or other contaminants at the bottom of the cylindrical cavities 411-414.

Each of the cylindrical cavities 411-414 has one of the corresponding drainage slots 441-444 that provide fluid communication between each cylindrical cavity and an outer surface of main connector body 401. Each of the drainage slots 441-444 extends from the uppermost surface of the main connector body 401, along the length of the cylindrical cavity, and below the bottom of the cylindrical cavity.

Each of the cylindrical cavities 411-414 preferably has four ridges that protrude toward the inner volume of the cylindrical cavities 411-414 and extend along bottom of the cylindrical cavity to the upper surface of main connector body 401. For example, FIG. 4B depicts cylindrical cavity 411 having ridges 431, 432, 433, and 434.

Figure 5A:
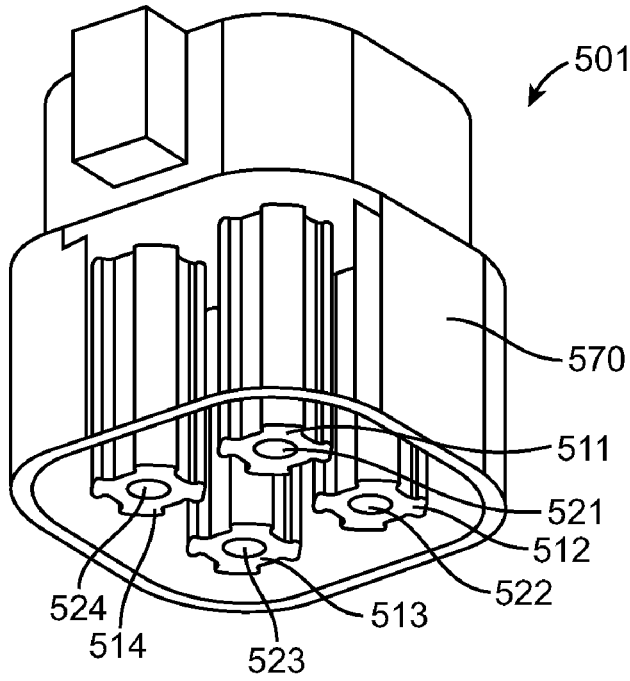
FIG. 5A is a side, perspective view of a second preferred female connector housing.
Figure 5B:
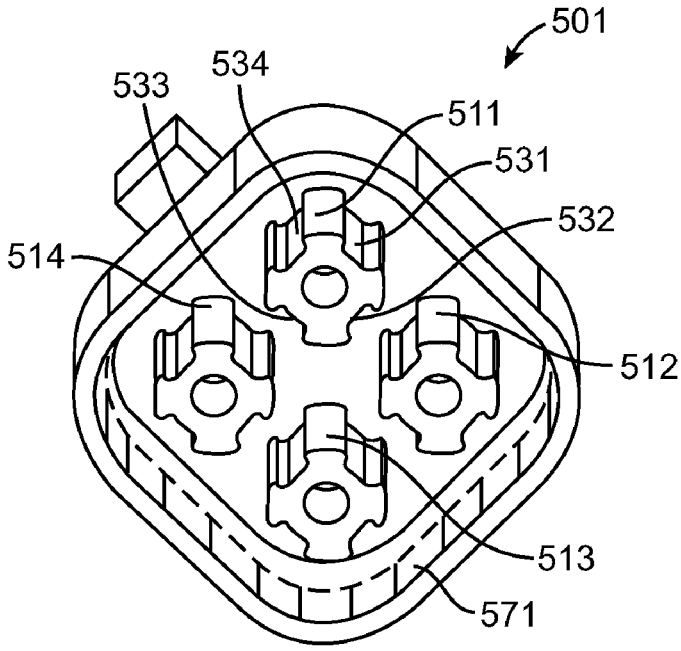
FIG. 5B is a bottom, perspective view of a second preferred female connector housing.
Figure 8A:
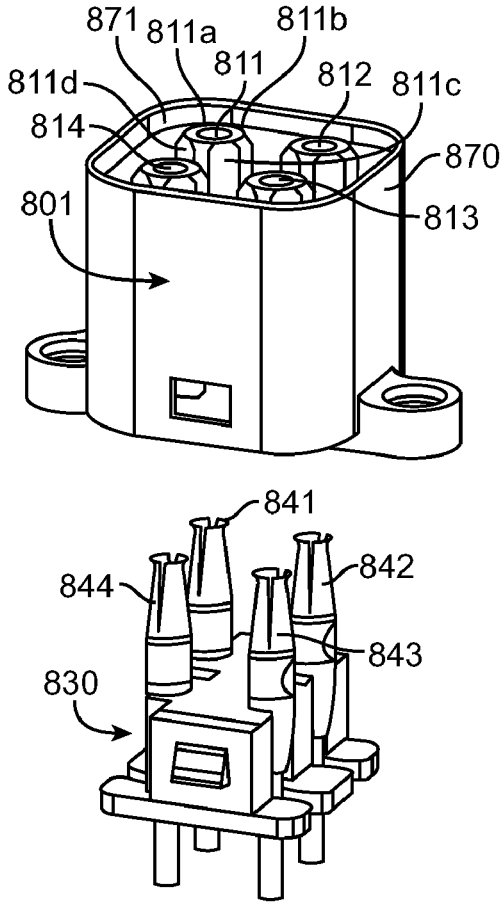
FIG. 8A is an exploded, perspective view of a third preferred female connector housing and a female terminal positioner.

FIG. 5A is a side, perspective view and FIG. 5B is a bottom, perspective view of a second preferred female connector housing 501. Female connector housing 501 has four cylinders 511-514 that emerge from an upper inner surface of female connector housing 501. Cylinders 511-514 are configured to mate with the corresponding cylindrical cavities 411-414. Each cylinder 511-514 has openings 521-524, each defining a diameter slightly larger than the diameter of male pins 421-424 such that male pins 421-424 are wiped and cleaned as female connector housing 501 is pressed onto main connector body 401. Openings 521-524 preferably may hold female connectors configured for receiving male pins 421-424 as depicted in FIG. 8A for example.

Female connector housing 501 has shroud 570 that surrounds cylinders 511-514. The inner surface of shroud 570 has an inner tapered surface 571 that is adopted for aligning and mating female connector housing 501 and male connector housing 401.

Cylinders 511-514 preferably have four indentations extending along the length of the cylinders that correspond to the four ridges formed in the cylindrical cavities 411-414. For example, FIG. 5B depicts cylinder 511 having indentations 531, 532, 533, and 534.

Figure 6A:
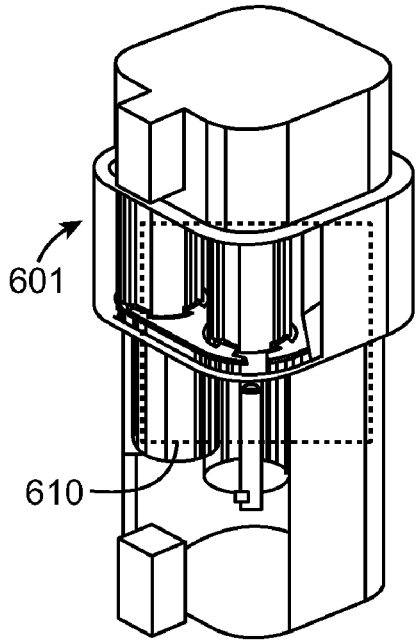
FIG. 6A is an exploded, perspective view of the mating of the second preferred main connector body and the second preferred female connector housing to form a second preferred assembled electrical connection.

FIG. 6A is an exploded, perspective view of the mating of the main connector body 401 and the female connector housing 501 to form an assembled electrical connection 601. Cylinders 511-514 of the female connector housing 501 are aligned and inserted into the corresponding cylinder cavities 411-414 of the main connector body 401.

Figure 6B:
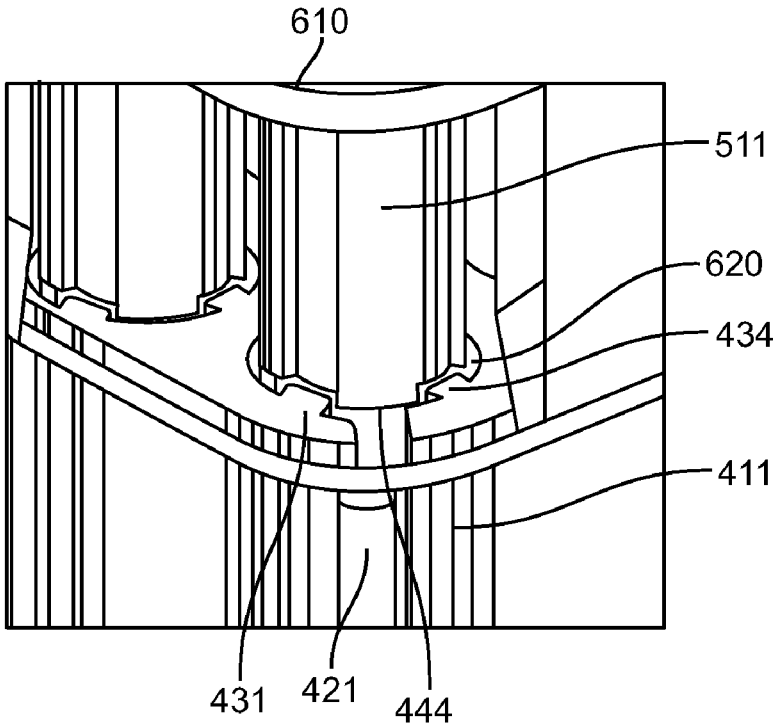
FIG. 6B is a cutaway, perspective view of the cylinder mating with the cylinder cavity.
Figure 6C:
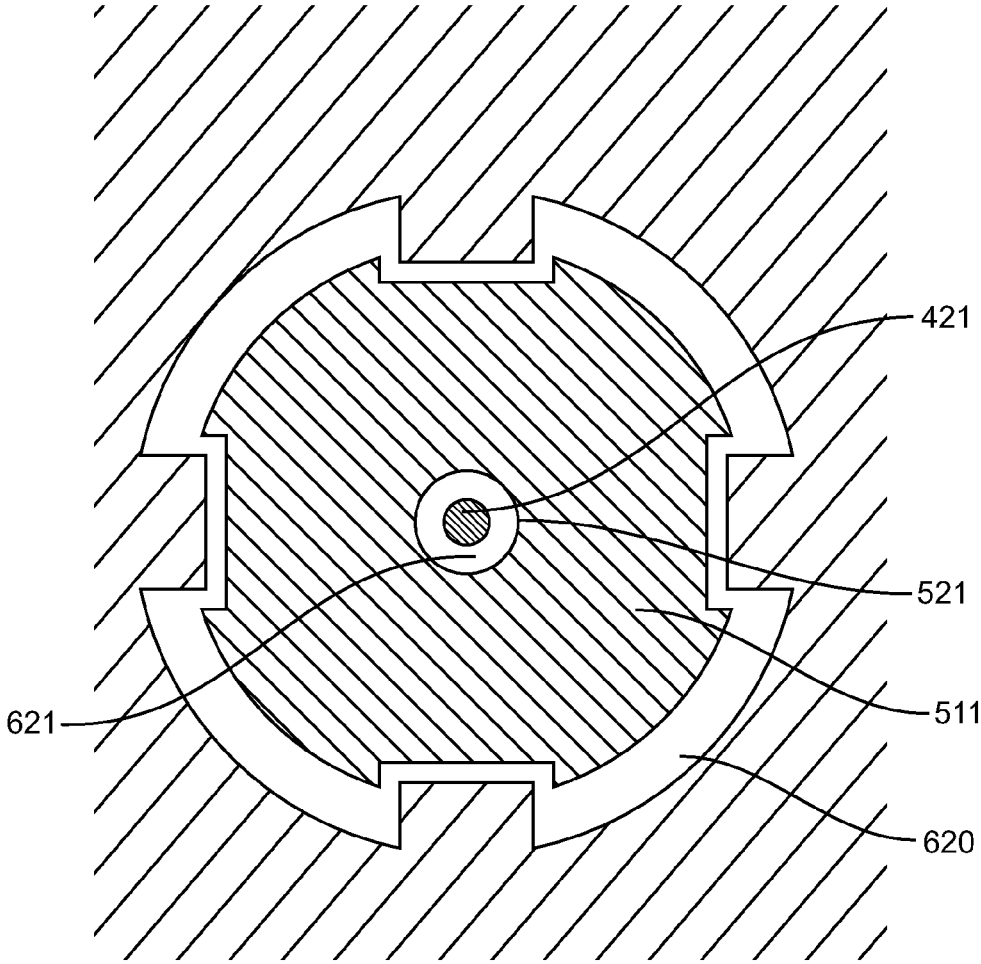
FIG. 6C is a cross-sectional, top view of a cylinder mating with the cylinder cavity.

FIG. 6B is a cutaway, perspective view of cylinder 511 mating with the cylinder cavity 411. The cylinders 511-514, the cylinder cavities 411-414, and the male pins 421-424 are configured to wipe and clean water or other contamination from the surfaces during the mating process. For example, cylinder 511 aligns with and is inserted into cylinder cavity 411. FIG. 6C is a cross-sectional, top view of cylinder 511 mating with cylinder cavity 411. Fluid-tight annular spaces between the cylinders and the corresponding are preferably formed. For example, fluid-tight annular space 620 surrounds cylinder 511 as illustrated in FIG. 6B and FIG. 6C. Another set of fluid-tight annular spaces are also preferably formed between male pins 421-424 and the openings 521-524 when the cylinders 511-514 are pressed onto main connector body 401. For example, as depicted in FIG. 6C, fluid-tight annular space 621 is formed around male pin 421. These fluid-tight annular spaces displace contaminants from the adjacent surfaces as female housing 501 is mated with main connector body 401.

Silicone wipes preferably may be employed to wipe male pins 421-424 and cylinders 511-514 during the mating process. As a result, any water or other contaminants that may have been present on male pins 421-424, cylinders 511-514, and cylindrical cavities 411-414 will be displaced and drained out of drain slots 441-444 during the mating process.

Figure 7A:
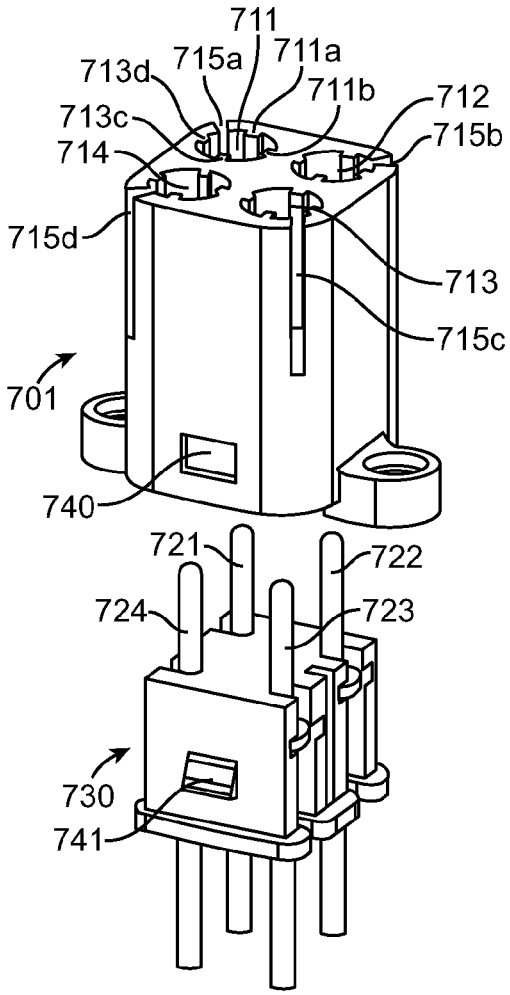
FIG. 7A is an exploded, perspective view of a third preferred male connector housing and a male terminal positioner.

FIG. 7A is an exploded, perspective view of a third preferred male connector housing 701 and a male terminal positioner 730. Male terminal positioner 730 has four male pins 721-724. Male connector housing 701 has cylindrical cavities 711-714 where each cylindrical cavity has an opening configured for accepting a corresponding male pin. For example, cylindrical cavity 711 is configured for accepting male pin 721, cylindrical cavity 712 is configured for accepting male pin 722, and so forth.

Male connector housing 701 has drainage slots 715*a*, 715*b*, 715*c*, and 715*d* which fluidly couples each cylindrical cavity with an outer surface of male connector housing 701. Each of drainage slots 715*a*-715*d* extends from the uppermost surface of male connector housing 701, along the length of each cylindrical cavity, and below the bottom of each cylindrical cavity.

Cylindrical cavities 711-714 each has four ridges protruding from the inner surface of the cylinder cavity and extends along the length of each cylinder cavity. For example, cylindrical cavity 711 has ridges 711*a*, 711*b*, 711*c*, and 711*d* that runs along the length of cylindrical cavity 711.

Figure 7B:
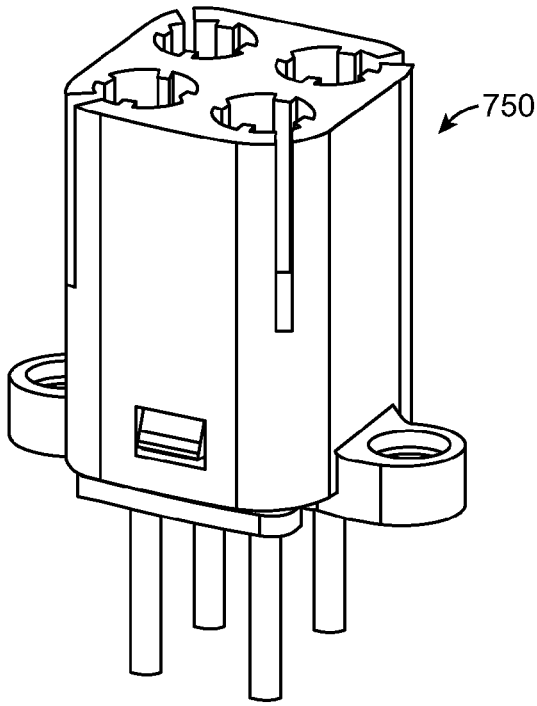
FIG. 7B is an assembled, perspective view of the third preferred male connector housing coupled to the male terminal positional.

FIG. 7B is an assembled, perspective view of the third preferred male connector housing 701 coupled to the male terminal positional 730. Male connector housing 701 couples with male terminal positioner 730 by tab 741 engaging opening 740 to form male connector assembly 750. Other forms of coupling, such as fasteners, screws, and adhesives, etc., may also be employed.

FIG. 8A is an exploded, perspective view of a third preferred female connector housing 801 and a female terminal positioner 830. Female terminal positioner 830 has four female connectors 841-844. Female connector housing 801 has cylinders 811-814 where each cylinder has an opening configured for accepting a corresponding female connector. For example, cylinder 811 is configured for accepting female connector 841, cylinder 812 is configured for accepting female connector 842, and so forth.

Each cylinder 811-814 has four indentations running along the length of the each cavity. For example, cylinder 811 has indentations 811*a*, 811*b*, 811*c*, and 811*d* that extend along the length of cylinder 811.

Female connector housing 801 has shroud 870 that surrounds cylinders 811-814. The inner surface of shroud 870 has an inner tapered surface 871 that is adopted for aligning female connector assembly 850 and male connector housing 750.

Figure 8B:
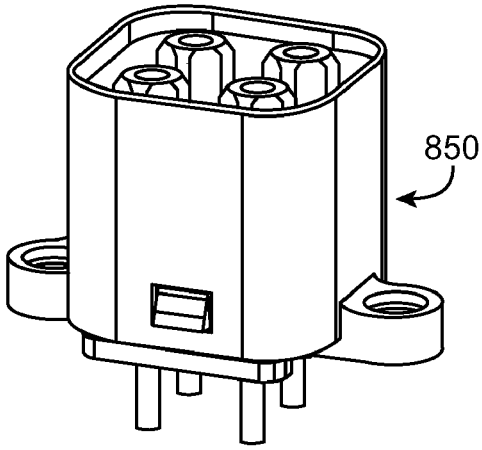
FIG. 8B is an assembled, perspective view of the female connector housing coupled to the female terminal positional.

FIG. 8B is an assembled, perspective view of the female connector housing 801 coupled to the female terminal positional 830. Female connector housing 801 couples with female terminal positioner 830 by tab 861 engaging opening 860 to form female connector assembly 850.

Figure 9A:
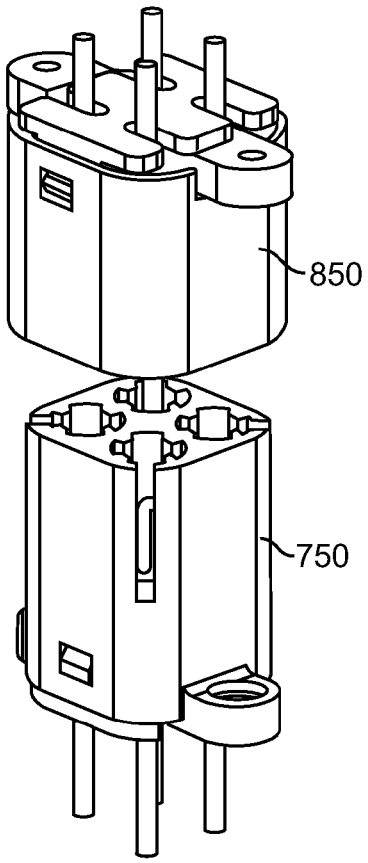
FIG. 9A is an exploded, perspective view of a third preferred female connector assembly and a third preferred male connector assembly.
Figure 9B:
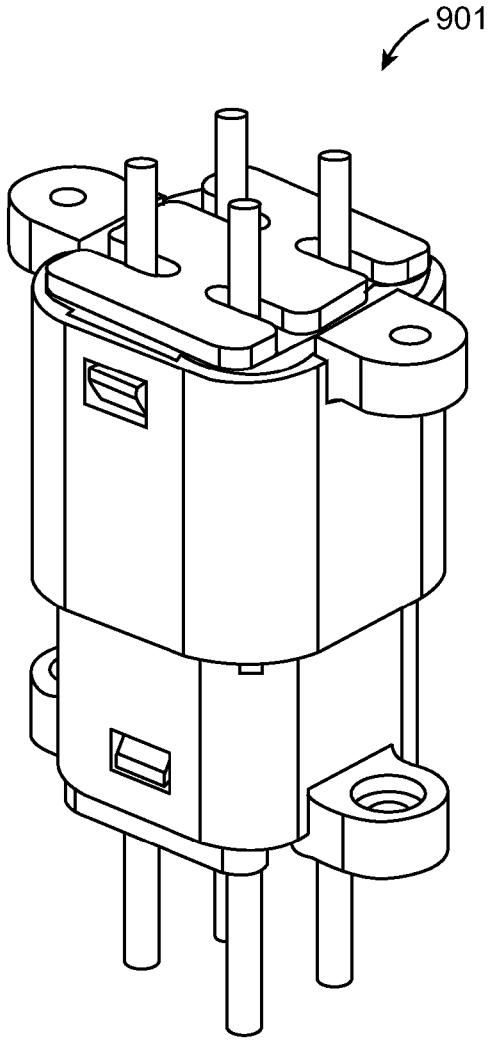
FIG. 9B is an assembled, perspective view of the third preferred assembled electrical connector.
Figure 10:
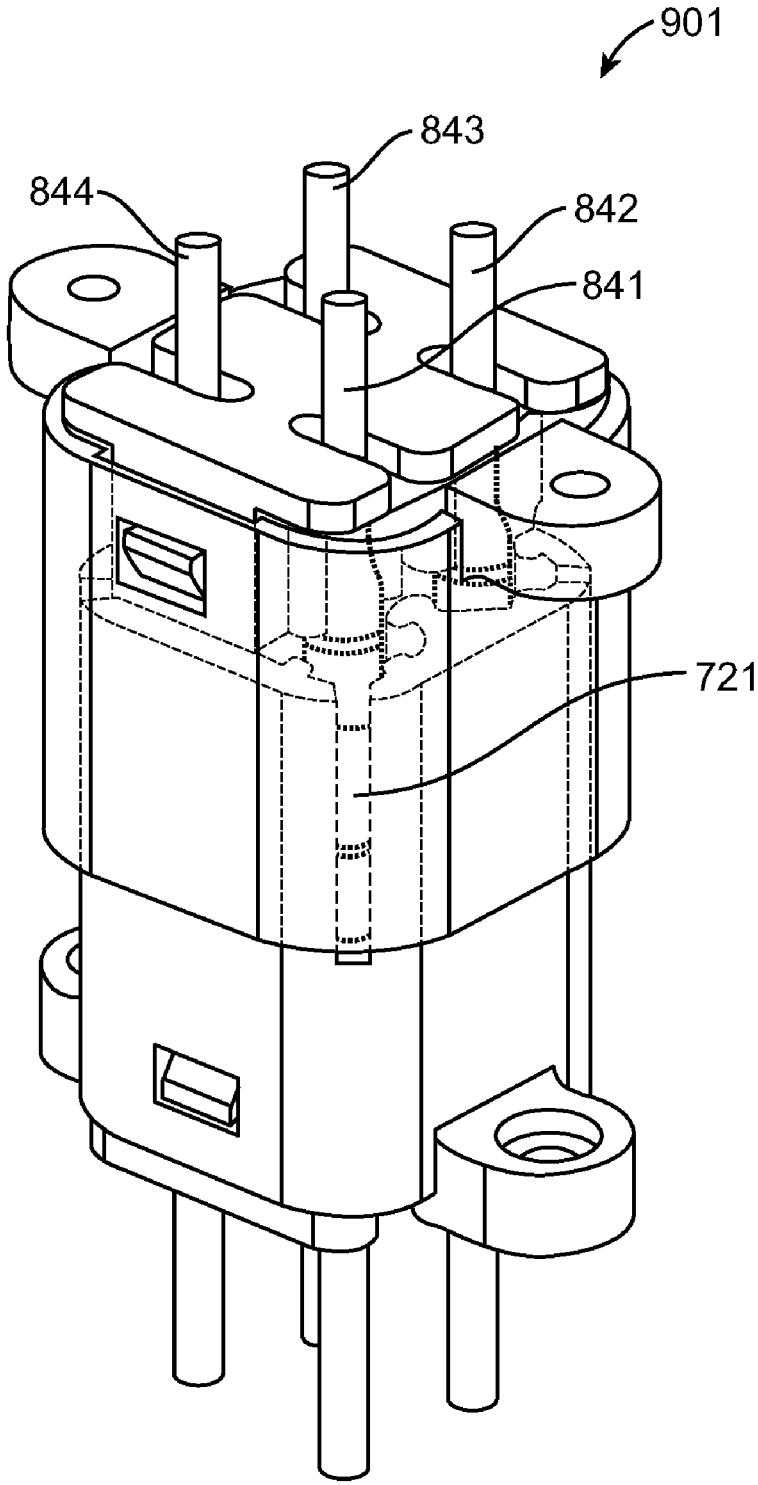
FIG. 10 is a cutaway, perspective view of a female connector receiving a male pin to form an electrical connection.

FIG. 9A is an exploded, perspective view of a third preferred female connector assembly 850 and a third preferred male connector assembly 750. Female connector assembly 850 is aligned with male connector assembly 750 to form assembled connector 901 as depicted in FIG. 9B. FIG. 10 is a cutaway, perspective view of female connector 841 receiving male pin 721 to form an electrical connection.

Cylinders 811-814, cylinder cavities 711-714, and male pins 721-724 are configured to wipe and clean water or other contamination from the surfaces. Cylinders 811-814 and the corresponding cylinder cavities 711-714 preferably form a set of fluid-tight annular spaces that surround each cylinder during the process of mating male connector assembly 750 and female connector assembly 850. Each opening of cylinders 811-814 and the corresponding male pins 721-724 preferably forms another set of fluid-tight annular spaces that surround male pins 721 during the process of connecting male connector assembly 750 and female connector assembly 850. These fluid-tight annular spaces displace contaminants from the adjacent surfaces as male connector assembly 750 is mated with female connector assembly 850. Examples of fluid-tight annular spaces are depicted in FIG. 6C.

Silicone wipes may preferably be employed to wipe male pins 721-724 and cylinders 811-814. As a result, any water or other contaminants that may have been present on male pins 721-724, cylinders 811-814, and cylindrical cavities 711-714 will be displaced and drained out of drain slots 715*a*-715*d*.

Although the invention has been discussed with reference to specific embodiments, it is apparent and should be understood that the concept can be otherwise embodied to achieve the advantages discussed. The preferred embodiments above have been described primarily as an electrical connection assembly having at least two housings where contaminants are displaced during the connection process. In this regard, the foregoing description of the electrical connector assembly is present for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An electrical connector assembly comprising:

a first housing having at least one male elongated pin member;

a second housing configured to mate with said first housing, said second housing having at least one opening for receiving a corresponding male elongated pin member of said at least one male elongated pin member, wherein:

said second housing is configured for displacing contaminants to a drainage pathway during a process of connecting said second housing and said first housing;

said second housing further comprises a top surface and at least one locking tab;

said at least one male elongated pin member extends beyond said top surface of said second housing when said second housing is coupled to said first housing; and said at least one opening forms at least one fluid-tight annular space surrounding said corresponding male elongated pin member during said process of connecting said second housing and said first housing.

2. The electrical connector assembly of claim 1, wherein:

said process of connecting said second housing and said first housing further comprises wiping contaminants from said corresponding male elongated pin member and displacing contaminants between said first housing and said second housing; and, said contaminants from said corresponding male elongated pin member and said contaminants between said first housing and second housing are discharged through said drainage pathway.

3. The electrical connector assembly of claim 2, further comprising a third housing having at least one female connector adopted for receiving said corresponding male elongated pin member.

4. The electrical connector assembly of claim 3, further comprising a connector body casing having drain ports and at least one notch, wherein:

said first housing is affixed to said connector body casing; and, said second housing is adopted for locking in place on said first housing by said at least one locking tab on said second housing engaging with said at least one notch on said connector body casing.

5. An electrical connector assembly comprising:

a first housing having at least one male elongated pin member; and, a second housing configured to with said first housing, said second housing having at least one opening for receiving a corresponding male elongated pin member of said at least one male elongated pin member, wherein:

said second housing is configured for displacing contaminants to a drainage pathway during a process of connecting said second housing and said first housing;

said first housing comprises at least one cylindrical cavity that extends away from said top surface of said first housing; and, said at least one male elongated pin member is aligned with said axis of said at least one cylindrical cavity and extends from said bottom of said at least one cylindrical cavity.

6. The electrical connector assembly of claim 5, wherein:

said drainage pathway further comprises at least one drainage slot that fluidly couples at least one cylindrical cavity with an outer surface of said first housing; and, at least one drainage slot extends from said top surface of said first housing, along said length of said at least one cylindrical cavity, and extends below said bottom of said at least one cylindrical cavity.

7. The electrical connector assembly of claim 6, wherein:

said second housing further comprises at least one cylinder configured to mate with a corresponding cylindrical cavity of said at least one cylindrical cavity;

said at least one cylinder extends from an inner surface of said second housing;

said at least one cylinder has one opening of said at least one opening; and, said opening further comprises a female electrical connector adopted for receiving said corresponding male elongated pin member.

8. The electrical connector assembly of claim 7, wherein:

said at least one cylinder cavity further comprises four ridges protruding from said inner surface of said at least one cylinder cavity and extending along said length of said at least one cylinder cavity; and, said at least one cylinder further comprises four indentations extending along said length of said at least one cylindrical cavity.

9. The electrical connector assembly of claim 8, wherein:

said at least one cylinder and said corresponding cylinder cavity forms at least one fluid-tight annular space surrounding said at least one cylinder during said process of connecting said second housing and said first housing; and, said opening and said corresponding male elongated pin member forms another at least one fluid-tight annular space surrounding said corresponding male elongated pin member during said process of connecting said second housing and said first housing.

10. The electrical connector assembly of claim 9, wherein:

said process of connecting said second housing and said first housing further comprises wiping contaminants from said at least one male elongated pin member, and displacing contaminants between said at least one cylinder and said corresponding cylindrical cavity; and, said contaminants from said at least one male elongated pin and said contaminants between said at least one cylinder and said corresponding cylindrical cavity are discharged through said at least one drainage slot.

11. The electrical connector assembly of claim 10 wherein:

said second housing further comprises a shroud that surrounds said at least one cylinder; and, said shroud has an inner tapered surface that is adopted for aligning and mating with said first housing.

12. The electrical connector assembly of claim 11, wherein:

said at least one cylinder cavity further comprises four cylinder cavities; and, said at least one cylinder further comprises four cylinders.

13. An electrical connector assembly comprising:

a male connector assembly comprising:

a male terminal positioner having four male elongated pin members; and a male connector housing having four cylindrical cavities, wherein:

each cylindrical cavity has an opening configured for accepting a corresponding male elongated pin member of said four elongated pin members;

said male terminal positioner is configured for coupling with said male connector housing to form said male connector assembly;

said male connector housing further comprises four drainage slots that fluidly couples each cylindrical cavity with an outer surface of said male connector housing;

each drainage slot of said four drainage slots extends from said uppermost surface of said male connector housing, along said length of said each cylindrical cavity, and extends below said bottom of said each cylindrical cavity; and, a female connector assembly comprising:

a female terminal positioner having four female connectors having open end portions configured for receiving a corresponding male elongated pin member of said four male elongated pin members; and, a female connector housing having four cylinders having axial openings configured for accepting a corresponding female connector of said four female connectors, wherein said four cylinders are configured to mate with corresponding cylindrical cavities;

wherein said female terminal positioner is configured for coupling with said female connector housing to form said female connector assembly; and wherein said male connector assembly is configured for coupling with said female connector assembly.

14. The electrical connector assembly of claim 13, wherein:

said each cylinder cavity further comprises four ridges protruding from said inner surface of said each cylinder cavity and extending along said length of each cylinder cavity; and, each cylinder further comprises four indentations running along said length of said each cavity.

15. The electrical connector assembly of claim 14, wherein:

said each cylinder and said corresponding cylinder cavity forms a fluid-tight annular space surrounding said each cylinder during said process of connecting said male connector assembly and said female connector assembly; and, said each opening and said corresponding male elongated pin member forms another fluid-tight annular space surrounding said corresponding male elongated pin member during said process of connecting said male connector assembly and said female connector assembly.

16. The electrical connector assembly of claim 15, wherein:

said process of connecting said male connector assembly and said female connector assembly further comprises wiping contaminants from said four male elongated pin members, and displacing contaminants between said four cylinders and said corresponding cylindrical cavities;

said contaminants from said four male elongated pin members and said contaminants between said four cylinders and said corresponding cylindrical cavities are discharged through one or more drainage slots of said four drainage slots.

17. The electrical connector assembly of claim 16 wherein:

said female connector housing further comprises a shroud surrounding said four cylinders; and, said shroud has an inner tapered surface that is adopted for aligning said female connector housing and said male connector housing.

18. An electrical connector assembly comprising:

a male connector housing having four cylindrical cavities that extend away from said top surface of said male connector housing, wherein:

each cylindrical cavity of said four cylindrical cavities has a male elongated pin member that is aligned with said axis of said each cylindrical cavity and extends from said bottom of said each cylindrical cavity;

each cylindrical cavity has one drainage slot that extends from said top surface of said male connector housing, along said length of said each cylindrical cavity, and below said bottom of said each cylindrical cavity;

said each cylinder cavity further comprises four ridges protruding from said inner surface of said each cylinder cavity and extending along said length of said each cylinder cavity;

a female connector housing having four cylinders that extend from an inner surface of said female connector housing; wherein:

each cylinder of said four cylinders is configured to mate with a corresponding cylindrical cavity of said four cylindrical cavities;

each cylinder has one opening located at said axis of said each cylinder;

said opening further comprises a female electrical connector adopted for receiving said corresponding male elongated pin member;

said each cylinder further comprises four indentations extending along said length of said each cylindrical cavity;

said female connector housing further comprises a shroud that surrounds said four cylinders;

said shroud has an inner tapered surface that is adopted for aligning and mating with said male connector housing;

wherein:

said each cylinder and said corresponding cylinder cavity forms a fluid-tight annular space surrounding said each cylinder during a process of connecting said female connector housing and said male connector housing;

said opening and said corresponding male elongated pin member forms another fluid-tight annular space surrounding said corresponding male elongated pin member during said process of connecting said female connector housing and said male connector housing;

said contaminants from said corresponding male elongated pin and said contaminants between said each cylinder and said corresponding cylindrical cavity are discharged through said drainage slot of each cylindrical cavity.

* * * * *